United States Patent [19]

Budrose

[11] 4,084,455

[45] Apr. 18, 1978

[54] ADJUSTABLE WRENCH

[75] Inventor: Charles R. Budrose, Melrose, Mass.

[73] Assignee: Upaya, Inc., Saugus, Mass.

[21] Appl. No.: 719,934

[22] Filed: Sep. 2, 1976

[51] Int. Cl.[2] ..... B25B 13/14

[52] U.S. Cl. ..... 81/140; 74/577 M

[58] Field of Search ..... 74/577 M; 81/130 R, 81/133, 134, 140, 155, 165

[56] References Cited

U.S. PATENT DOCUMENTS

| | | | |
|---|---|---|---|
| 1,096,317 | 5/1914 | Peoples | 81/134 |
| 1,234,422 | 7/1917 | Toczek et al. | 81/140 X |

FOREIGN PATENT DOCUMENTS

| | | | |
|---|---|---|---|
| 18,214 | 9/1904 | Denmark | 81/140 |

*Primary Examiner*—Al Lawrence Smith
*Assistant Examiner*—James G. Smith
*Attorney, Agent, or Firm*—Wolf, Greenfield & Sacks

[57] ABSTRACT

An easily adjustable wrench having jaws that move relative to each other. The moving mechanism comprises a pinion gear which is pivotally mounted from one of the jaws and a gear rack on the other jaw with which the pinion gear engages. An actuating button pivots the pinion gear out of engagement with the rack for quick adjustment between the jaws while the pinion gear may be manually rotated for finer adjustments.

9 Claims, 3 Drawing Figures

ADJUSTABLE WRENCH

BACKGROUND OF THE INVENTION

The present invention relates in general to adjustable hand wrenches, variously known also as monkey wrenches, crescent wrenches or Stillson wrenches. More particularly, the present invention relates to an improvement in an adjustable wrench and particularly having to do with the ease and speed of adjustment of the adjustable wrench.

The typical adjustable wrench has a knurled worm gear which is rotated to make the adjustment by moving one jaw of the wrench. Ideally, this can be done by the thumb of the hand holding the wrench leaving the other hand free. However, often there is not sufficient room to accomplish the thumb movement necessary to make the adjustments. Because of the poor mechanical advantage of the knurled adjustment screw and the amount of movement necessary to make an adjustment, it is found that it is more reasonable to hold the wrench with one hand and make the adjustment with the other hand. Thus, the adjustment is a relatively time consuming process.

Another problem with the knurled screw adjustment device is that the direction of thumb movements relative to the hand is not constant; it reverses as the wrench faces left and right and also reverses as the wrench is held pointing up and pointing down. There is also interaction between the plains of rotation, as well as when the wrench is in an intermediate position within a plane, i.e., such as when the wrench points neither left nor right but perpendicular to the user. Accordingly, there is an unsureness on the part of the user as to which direction to move his thumb to open or close the wrench. This becomes additionally time consuming as the user engages in trial and error experimentation.

One type of an adjustable open end wrench is shown in U.S. Pat. No. 3,555,939. However, there are disadvantages associated with a type of wrench as shown in this patent. This prior art wrench contains relatively expensive components and is relatively complex to construct. Also, this prior art device is quite susceptible to malfunction due to dirt or metal pieces and requires a relatively smooth metal contact between certain components.

Accordingly, one object of the present invention is to provide an adjustable wrench having means for providing adjustment of the wrench by a relatively fast thrust of the thumb of the user.

Another object of the present invention is to provide an adjustable wrench which permits easy adjustment even in close quarters.

Still a further object of the present invention is to provide an adjustable wrench which has its adjustment movement always in a fixed direction, i.e., either toward or away from the wrench jaws.

Still another object of the present invention is to provide an adjustable wrench that is relatively simple in construction, uses relatively inexpensive parts, is easy to operate and also easy to clean.

SUMMARY OF THE INVENTION

To accomplish the foregoing and other objects of this invention there is provided an adjustable wrench which comprises a pair of jaws and means for supporting the jaws for relative movement therebetween to open and close the jaws. One of the jaws has tooth means associated therewith which is preferably in the form of a gear rack. The wrench also comprises pinion gear means associated with the other jaw, means for pivotally supporting the pinion gear means and means operatively related to the pinion gear means for limiting rotation of the pinion gear means to one direction of rotation. The means for supporting the pinion gear means preferably includes an actuating means which can be depressed for pivoting the pinion gear means away from the tooth means. A biasing means preferably in the form of a small leaf spring forces the pinion gear means into engagement with the tooth means when the actuating means is not used.

The biasing means normally maintains the pinion gear means in contact with the tooth means and fine adjustment can be provided by manually rotating the pinion gear means. For a quick adjustment the actuating means may be depressed to disengage the pinion gear means for the tooth means. The jaws can then rapidly be opened or adjusted to any desired position with the simple movement of the thumb.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
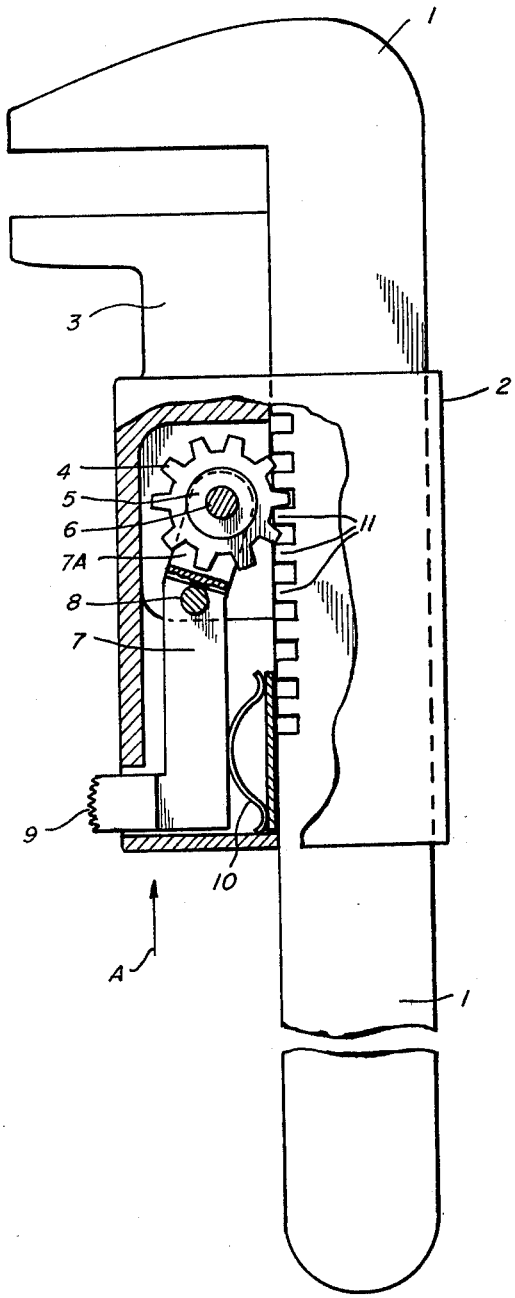
FIG. 1 is a side view of the wrench partially cut away to show the mechanisms thereof.
Figure 2:
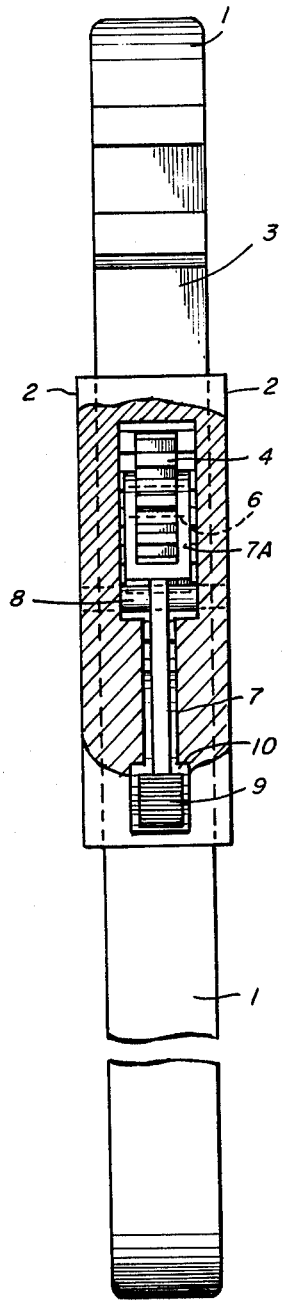
FIG. 2 is a front view of the wrench shown in FIG. 1.

Referring now to the drawings there is shown a combination fixed jaw and handle 1 which is slidingly affixed by a U-shaped bracket 2 to the other jaw 3. The bracket 2 may be secured to the jaw 3 in a suitable manner such as by using rivets and extends about the jaw 1. The jaw 1 is provided along one flat surface with gear teeth 11 as shown in FIG. 1.

The pinion gear 4 is supported for engagement and disengagement from the teeth 11. This gear 4 may also be manually rotated for providing fine adjustment between the jaws 1 and 3. The gear 4 is firmly attached to a uni-directional bearing 5 which is secured about shaft 6. The bearing 5 may be of conventional design and include a pawl or the like arrangement permitting relative rotation between the gear 4 and the shaft 6 in only one direction which is the clockwise direction as shown in FIG. 1.

Figure 3:
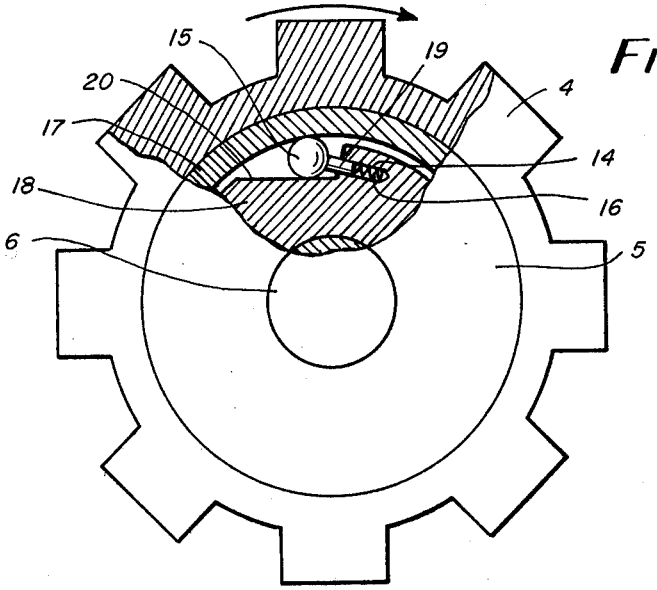
FIG. 3 is a side view of the uni-directional bearing and pinion gear assembly partially cut away to show the uni-directional mechanism.

FIG. 3 shows one version of a uni-directional bearing 5 and its construction and relationship with regard to the shaft 6 and the gear 4. This bearing or clutch may be made by Morse, which is a division of Borg-Warner and identified as one of their series K1, NSS, NFS, or GFR. In FIG. 3 the roller 15 is spring loaded by means of the spring 16 against the outer bearing race 17 and the inner bearing race 18. A plunger 19 interconnects between the spring 14 and the roller 15. A number of rollers 15 may be disposed about the periphery of the bearing. The plunger 19 and the spring 16 are contained in a round channel 14. The inner surface of the outer bearing race 17 and the flat surface 20 on the inner bearing race 18 form an inclined plane. Inner bearing race 18 is firmly attached to shaft 6 while the outer bearing race 17 is firmly attached to gear 4.

There is free rotation of the gear 4 in the clockwise direction, with roller 15 being driven out of the wedge formed by the inclined flat surface 20 and the outer bearing race 17. On the other hand gear 4 will not rotate in the counter clockwise direction because the roller is forced up the inclined ramp locking the roller 15 and the outer bearing race 17 because the distance between the races is slightly smaller than the roller diameter. Therefore, there is free clockwise rotation of gear 4 but no counter clockwise rotation. The spring loaded plunger 19 keeps the roller 15 in very tight contact with the races to assure instantaneous engagement when race rotation is reversed. As previously mentioned, one uni-directional bearing has several rollers and associated cam surfaces.

Shaft 6 is not a rotating shaft but is firmly affixed to the bifurcated end 7A of the release lever 7. The release lever 7 is rotatably mounted on a fixed position shaft 8 which is in turn firmly attached to the moveable jaw 3. Release lever 7 terminates at its bottom end in a serrated release pad or button 9. The release lever 7 is urged away from jaw 1 by means of spring 10 which is a relatively small leaf spring. The spring 10 is suitably secured from the jaw 3.

When the lower edge of the jaw 3 is moved in the direction of arrow A the jaw 3 easily moves upwardly in a closing direction of the jaws. This movement is made assuming that the button 9 has not been depressed and that the gear 4 is in engagement with the teeth 11. This movement is permitted because of the permitted clockwise rotation of the gear 4. Because of the uni-directional bearing 5 movement in the opposite direction or opening of the jaws is not permitted while there is engagement of the gear 4 with the teeth 11. To open the wrench the release pad or button 9 is depressed thereby rotating the release lever 7 about fixed shaft 8. This action lifts the pinion gear 4 away from the teeth 11 on jaw 1. Thus, after and during depression of the tab 9, the moveable jaw 3 can be moved downwardly in a direction opposite to the direction of arrow A opening the jaws of the wrench. Again, to close the jaws of the wrench a pressure is applied to the bottom edge of the jaw 3 in the direction of arrow A.

Fine adjustment can be provided by manually rotating the gear 4, but it is not necessary that the gear 4 be even exposed to view. With the arrangement of the present invention the movement in a closing position is simply provided by pushing on the lower edge of the jaw 3 while opening is simply provided by depressing the button 9 with the thumb. Both of these actions can be accomplished quite easily and readily with the use of one hand.

Having described one embodiment of the present invention it should now become apparent that there are numerous modifications that can be made therein. For example, the gear 4 may be a worm gear in which case the teeth 11 would have configuration corresponding to the worm gear 4. The concepts of this invention are also applicable to many different shapes of jaws such as the common crescent wrench.

What is claimed is:

1. An adjustable wrench comprising;

a pair of jaws, means for supporting the jaws for relative movement therebetween to open and close the jaws, teeth on one of said jaws disposed along a linear track, an annular pinion gear associated with the other of said jaws, annular, uni-directionally rotatable means for supporting the pinion gear permitting rotation of the pinion gear in only one direction, means for supporting said uni-directionally rotatable means, actuating means coupled to said means for supporting said uni-directionally rotatable means for pivoting said pinion gear away from the teeth, and means for biasing the pinion gear into engagement with the teeth.

2. An adjustable wrench as set forth in claim 1 wherein said means for supporting said uni-directionally rotatable means comprises a shaft and said actuating means comprises a release lever forming at one end an actuating button and means for pivotally supporting the lever and in turn the gear from the said other jaw.

3. An adjustable wrench as set forth in claim 2 wherein said uni-directionally rotatable means comprises a uni-directional bearing.

4. An adjustable wrench as set forth in claim 3 wherein said means for biasing comprises a leaf spring supported from said other jaw and having a segment urging against said release lever.

5. An adjustable wrench as set forth in claim 4 wherein said means for supporting the jaws comprises a U-shaped bracket secured to one of said jaws and slideable relative to the other jaw.

6. An adjustable wrench as set forth in claim 1 wherein said actuating means comprises a lever means having an actuating button at one end and being bifurcated at the other end to accommodate the pinion gear.

7. An adjustable wrench as set forth in claim 6 wherein said uni-directionally rotatable means comprises a uni-directional bearing and said means for supporting said uni-directionally rotatable means comprises a shaft about which the bearing fits with the pinion gear fitted about the bearing.

8. An adjustable wrench as set forth in claim 7 including a pivot shaft for the lever means for supporting the lever means from the other jaw.

9. An adjustable wrench as set forth in claim 8 wherein the lever means has a turned end forming the actuating button which has a knurled surface.

* * * * *